US006128937A

United States Patent [19]

Seidel

[11] Patent Number: 6,128,937

[45] Date of Patent: Oct. 10, 2000

[54] METHOD AND INSTALLATION FOR SHAPING METAL STRIP IN A HOT STRIP ROLLING MILL

[75] Inventor: Jürgen Seidel, Kreuztal, Germany

[73] Assignee: SMS Schloemann-Siemag Aktiengesellschaft, Düsseldorf, Germany

[21] Appl. No.: 09/162,416

[22] Filed: Sep. 28, 1998

[30] Foreign Application Priority Data

Sep. 30, 1997 [DE] Germany ..... 197 43 115
Jun. 26, 1998 [DE] Germany ..... 198 28 575

[51] Int. Cl.[7] ..... B21D 1/05

[52] U.S. Cl. ..... 72/161; 72/201

[58] Field of Search ..... 72/161, 160, 162, 72/201

[56] References Cited

U.S. PATENT DOCUMENTS 4,074,555 2/1978 Noé ..... 72/201
4,316,376 2/1982 Masui et al. ..... 72/161
4,700,557 10/1987 De Mol ..... 72/201
5,724,845 3/1998 Yasumi ..... 72/161

FOREIGN PATENT DOCUMENTS 2163689 3/1986 United Kingdom ..... 72/161

*Primary Examiner*—Daniel C. Crane
*Attorney, Agent, or Firm*—Friedrich Kueffner

[57] ABSTRACT

A method and an installation for shaping metal strip in a hot strip rolling mill which includes a finishing train, a cooling line, a pinch roll unit, and a coiling unit, wherein, after emerging from a cooling line, the strip material is alternatingly conducted over and under at least two successively arranged stretcher-leveller work rolls which form a stretcher-leveller zone, and wherein the stretcher-leveller work rolls are arranged offset relative to each other in such a way that the metal strip is deflected at each stretcher-leveller work roll.

25 Claims, 7 Drawing Sheets

METHOD AND INSTALLATION FOR SHAPING METAL STRIP IN A HOT STRIP ROLLING MILL

BACKGROUND OF THE INVENTION

1. Field of the Invention

The present invention relates to a method and an installation for shaping metal strip in a hot strip rolling mill which includes a finishing train, a cooling line, a pinch roll unit, and a coiler.

2. Description of the Related Art

It is known in the art to roll metal after the casting process in a hot strip rolling mill until it reaches a certain thickness in order then to convey the resulting product after a coiling procedure to a cold strip rolling mill for rolling the product to the final dimension. In this connection, increasingly higher demands are made of the metal strip supplied to the cold strip rolling mill with respect to its mechanical and geometric properties, particularly its flatness.

Simultaneously, there is the tendency that the desired final properties of the metal strip, which result from the successively arranged processes of the hot and cold rolling mills, is already adjusted in the hot rolling process or that a hot strip is produced which meets optimum requirements for the subsequent cold rolling process. Simultaneously, the boundary conditions become more difficult during hot rolling. Increasingly thinner and wider products are desired for adjusting them to the final product; this requires a greater thickness reduction and the use of greater rolling forces in the end stands of the hot strip rolling mill train. Consequently, the wear of the rolls increases with the decreasing size of the roll gap. Moreover, the thermal crown of the rolls increases when the production on the rolling train is increased. These effects negatively influence the flatness of the hot strip and, thus, also the quality of the strip in the cold state.

A conventional means for producing flat hot strip is the use of adjusting actuators. However, in the case of extremely thin strips, currently hardly any or no reliable hot strip planarity measurements are available.

Moreover, in a hot strip rolling mill, in addition to the deviations from flatness resulting from the finishing train, flatness changes of the metal strip occur in the cooling line and are caused by the pinch rolls.

The strip leaves the finishing train partially with a non-uniform flatness or stress distribution over the strip width. Even in the case of equal boundary conditions, such as, geometric dimensions, tensions, temperatures, material, etc., this may have the result in strips which are rolled in rapid sequence that different flatnesses in the cold strip are produced. This uneven flatness distribution of the hot strip then results directly or indirectly in different flatness conditions of the cold strip because of changed coiling conditions at the coiler, for example, higher coil crown.

Furthermore, the strip planarity changes due to the deflection of the strip at the pinch roll unit in the direction of the coiler by the different tensile stress distribution over the width of the strip. Principal influencing variables in this connection are the ground pinch roll shape, the wear of the pinch rolls, the contact pressure as well as the thermal crown of the pinch rolls. However, an optimization of the surface of the pinch rolls resulting from grinding as well as a change of the pinch roll material and the manner of exchanging the pinch rolls can improve the boundary conditions.

When the strip is wind into a coil, a non-uniform tensile stress distribution is partially produced over the strip width.

In dependence on the tensile stress level, this non-uniform distribution produces different strip elongations over the strip width and, thus, non-planarities for the cold state. In this connection, principal influencing variables are the coil crown which is being adjusted. The shape of the coil depends on the strip contour, the strip flatness during coiling, the material strength (temperature, material quality) and the coiler tension.

A disadvantage is the fact that it is not possible to directly influence the changes of the planarity at the pinch roll as well as at the coiler and the changes caused by the winding of the coil. This produces local unflatnesses of the strip. Also, unsteadiness of the immediate strip end has been observed.

SUMMARY OF THE INVENTION

Therefore, it is the primary object of the present invention to provide a method and an installation for adjusting desired flatness and tension conditions in the hot strip, so that a flat strip is obtained in the cold state.

In accordance with the present invention, after emerging from a cooling zone, the strip material is alternatingly conducted over and under at least two successively arranged stretcher-leveller work rolls which form a stretcher-leveller zone, wherein the stretcher-leveller work rolls are arranged offset relative to each other in such a way that the metal strip is deflected at each stretcher-leveller work roll.

In accordance with another feature, the function of two stretcher-leveller work rolls can also be assumed solely by the two pinch rolls. In that case, the stretcher-leveller zone is provided by adjusting the upper or lower pinch roll into the area in front or following the original pinch roll position.

In contrast to a known arrangement for stretching and bending, as it is disclosed in DE 36 36 707 C2, the present invention proposes to arrange the stretcher-leveller zone at the end of the hot rolling process. The stretcher-leveller zone is formed by additional stretcher-leveller rolls in front of or following the pinch rolls or by the driver rolls themselves. In contrast, the German patent mentioned above discloses a stretching and bending arrangement with a subsequently arranged roll stand.

By guiding the strip through a stretcher-leveller zone formed in accordance with the present invention, the desired flatness and stress properties can be adjusted in the metal strip even before it is coiled into a coil. By using a higher quality, already flat hot strip, this makes it possible to essentially eliminate negative influences from the preceding processes and to improve the quality of the strip in the cold state.

Sufficient for this purpose in the simplest case are already two stretcher-leveller work rolls for forming a stretcher-leveller zone, wherein the metal strip is not rolled between the rolls, but is bent and stretched between the successively arranged rolls.

Consequently, it is possible to even out unflatnesses and to adjust more uniform stress conditions.

The aftertreatment of the strip by means of stretcher-leveller work rolls eliminates the unflatnesses resulting from the finishing train, for example, parabolical unflatnesses and unflatnesses of a higher degree, as well as the unflatnesses and stresses which are produced in the cooling line. Moreover, the use of these stretcher-leveller work rolls makes it possible to avoid or reduce disadvantageous damage to the strip end in the form of local unflatnesses and unsteadiness of the immediate strip end.

The proposed stretcher-leveller work rolls, which are arranged following the pinch roll unit and in front of the coiler, make it possible that, in addition to the unflatnesses resulting from the finishing train and the cooling line, even the flatness changes at the pinch rolls can be eliminated. Moreover, reproducible flatness conditions can be adjusted. In order to prevent damage to the strip surface, the rolls should be driven independently or should have a low moment of inertia.

On the other hand, it is also conceivable to produce a hot strip which is already ready for use and has the desired thin final dimensions. The stretcher rolls according to the present invention make it possible to adjust already in the hot strip a sufficient degree of flatness, so that in some cases the cold strip rolling process may be omitted altogether.

In accordance with an advantageous feature, the stretcher-leveller zone is formed by three stretcher-leveller work rolls of a first type which are arranged one behind the other. The stretcher-leveller rolls of the first type have a cylindrical shape.

In accordance with another advantageous embodiment of the invention, a stretcher-leveller work roll of a second type is used which advantageously is combined with two stretcher-leveller work rolls of the first type. Advantageously, the metal strip travels first through the stretcher-leveller zone formed by the rolls of the first type and then over the roll of the second type. By a specific configuration of the crown of this roll of the second type, it is then possible to then compensate any still existing non-planarities of the metal strip. This configuration makes it possible to produce over the strip width a non-uniform tension distribution, so that the strip can locally be stretched in such a way that it is as flat as possible in the cold state.

Of course, it is also conceivable that the stretcher-leveller unit is composed of only one stretcher-leveller work roll of the first type in combination with two stretcher-leveller work rolls of the second type.

This combination may include two successively arranged stretcher-leveller work rolls of the second type and, in front of the two rolls of the second type, a stretcher-leveller work roll of the first type which preferably is cylindrical. This increases the flexibility of the stretcher-leveller zone as a reaction to the different flatnesses of the strip which depends to a significant extent, as described above, on the finishing stretch and the cooling line.

By providing a roll of the second type, the cross bow of the strip, which frequently is observed in the cold state, is positively influenced.

It is also conceivable that the stretcher-leveller zone is composed of a stretcher-leveller roll or rolls of the second type with a subsequently arranged roll or rolls of the first type. Basically, all combinations with more than two rolls of the one or other type are conceivable.

For an optimum adjustment of the position or the contact pressure of this additional stretcher-leveller work roll of the second type, it is possible to utilize the measurement values for the strip contour, the strip temperature distribution, the strip thickness, and the tension level as well as the information concerning the regularities derived from the off-line cold linearity evaluation, etc. This may result in different adjustments of the stretcher-leveller work rolls over the strip length.

In accordance with another feature, the work roll of the second type may be composed of two separate roll bodies. This makes it possible to flexibly react to different strip widths or strip unflatnesses during the process because the roll can be appropriately adjusted since the roll bodies are mounted so as to be fixed or swinging and displaceable in orientation relative to the strip edge.

In accordance with an advantageous feature, the lower pinch roll can assume the task of the first stretcher-leveller work roll of the first type.

Alternatively, the stretcher-leveller zone can be exclusively formed by the upper and lower pinch rolls. This is achieved by laterally downwardly swinging the upper pinch roll when the coiler has grasped the strip beginning and, thus, the strip has been deflected at the pinch rolls.

In the embodiment with pinch rolls and stretcher-leveller rolls, these rolls usually also do not contact the strip at the strip beginning. The stretcher-leveller rolls are swung into the work position only after tensile stresses have been built up.

In accordance with an advantageous feature, a strip zone cooling unit, particularly a water-cooling unit, is provided in the stretcher-leveller zone. This strip zone cooling unit may preferably be constructed as a scale washer. Water is admitted with high pressure to the strip on both sides, which makes it possible to simultaneously remove the tertiary scale. A temperature measuring device is provided following the cooling zone, i.e., in front of the coiler.

It is also recommended that, in addition to the strip, the stretcher-leveller rolls are also cooled to reduce the thermal crown and the wear. Conventional water cooling units can be used for this purpose.

It is advantageous to carry out strip zone cooling not only in the stretcher-leveller zone, but also immediately in front of the coiler. Advantageous in this connection is the spraying technology using water or another liquid which serves as a gliding/separating agent. A gliding agent is recommended because the gliding properties of the strip layers relative to each other during cooling of the coil are advantageously influenced.

In accordance with a particularly preferred embodiment of the present invention, a stretcher-leveller zone is integrated at the end of a hot rolling process, i.e., even after travelling through the finishing train. In this connection, for adjusting a flat strip, it is proposed that the adjustment of the stretcher-leveller rolls relative to the strip and relative to each other are controlled by means of a first control circuit in dependence on the strip properties which are measured at the same time. Also, the strip tension level, which differs over the strip length, can be controlled.

For this purpose, it is possible, for example, that a flatness measuring roller is arranged following the stretcher-leveller zone as seen in strip travel direction. The flatness measuring roller is a segmented tension measuring roller. The values picked up by this measuring roller are used in the form of signals by a control circuit for controlling the stretcher-leveller adjusting actuators and/or the finishing train adjusting actuators for further influencing the flatness. It is conceivable that the rolls of the first and second type which form the stretcher-leveller zone are constructed as segmented tension measuring rollers.

Finally, it is proposed in accordance with another advantageous feature that a second control circuit is used for controlling the adjustments of the cooling line arranged in front of the stretcher-leveller zone in dependence on the strip properties. The control of the adjusting members of the stretcher-leveller zone are preferably coupled to the control of the adjusting actuators of the cooling line in such a way that both control circuits utilize a common desired value. The actual value and the desired value of these control circuits constitute the strip properties. They are, for example, the temperature distribution over the strip width, the strip contour and/or the strip tensions.

Conventional cooling patterns are used for controlling the cooling line. Conceivable are, for example, the adjustment of the cooling device in such a way that a reduced cooling effect occurs in the strip edge region or that an additional cooling effect is achieved in the strip edge region or a parabolic change of the temperature distribution is effected over the strip width.

As is well known, the changes of the temperature distribution over the strip width produce unflatnesses due to different thermal shrinking. In interaction with the subsequently arranged stretcher-leveller unit and the cooling behavior, these cooling patterns are applied in order to achieve a compensation of these effects and, thus, a more flat strip.

Finally, it is conceivable to control by means of an additional control circuit the mechanical adjusting members of the stretcher-leveller work rolls in dependence on the strip properties.

In order to be able to increase the tension level in a specified manner in the stretcher-leveller zone, it is additionally proposed to press a stretcher-leveller roll against a roll arranged underneath this stretcher-leveller roll, or to increase the depth of insertion of this roll, i.e, the extent by which the roll deflects the strip.

Alternatively, an additional pinch roll driver can be arranged in front of the stretcher-leveller zone as seen in the strip travel direction.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 2:
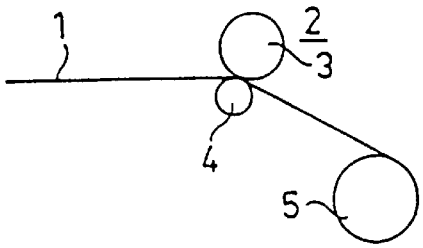
FIG. 2 is a schematic illustration of the end portion of a conventional hot strip rolling mill.

Following the rolling process in a hot strip rolling mill, the metal strip 1 travels over guide rollers over a pinch roll unit 2 composed of an upper pinch roll 3 and a lower pinch roll 4 toward a coiler 5 where the strip is coiled into a coil for further transport, usually to a cold rolling mill, as shown in FIG. 2 in connection with a conventional plant.

Figure 1:
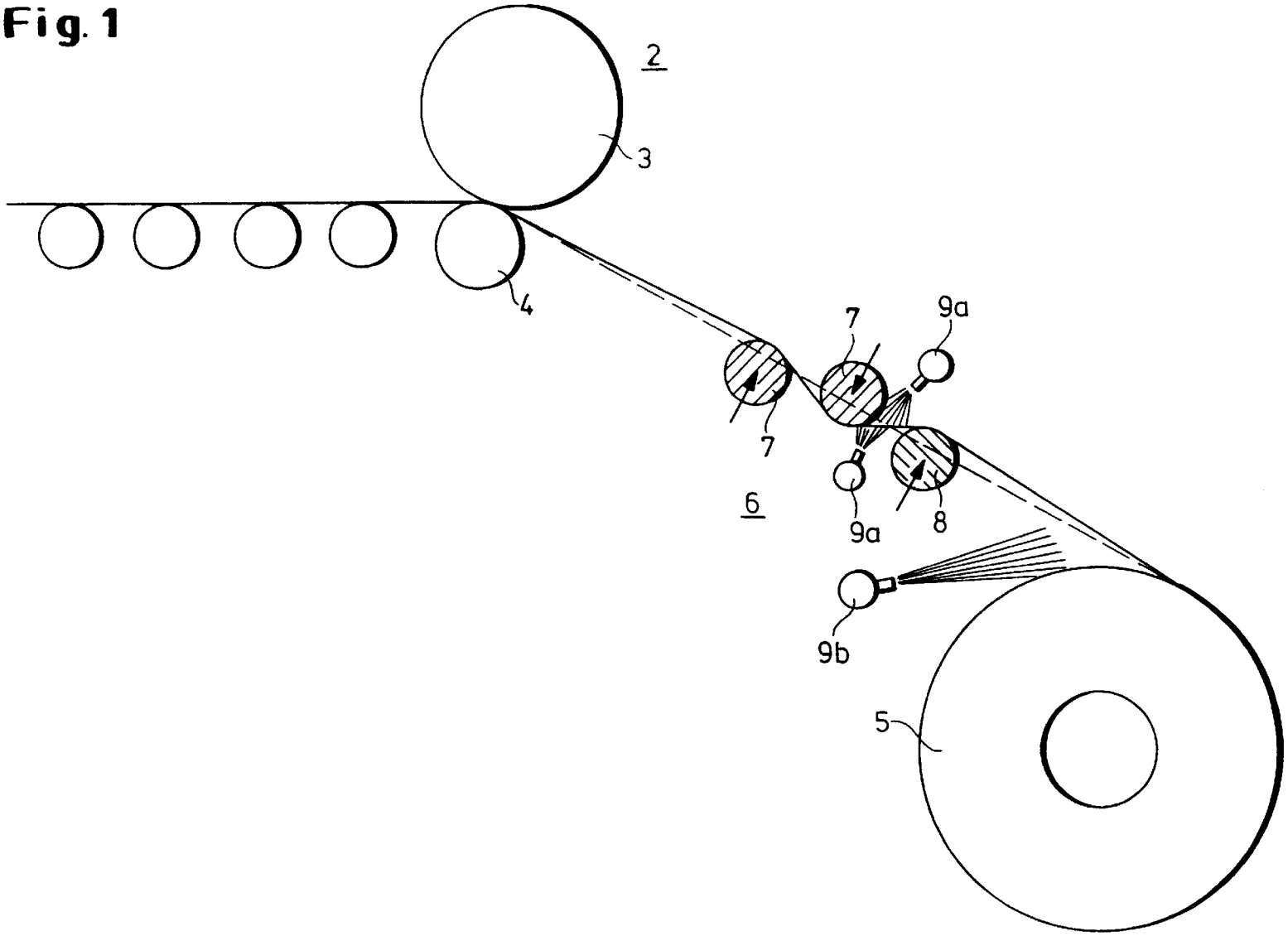
FIG. 1 is a schematic illustration of in-line stretcher-leveller rolls according to the present invention arranged between a pinch roll unit and a coiler of a hot strip rolling mill.

FIG. 1 shows that, in accordance with the present invention, a stretcher-leveller zone 6 is provided between the pinch roll unit 2 and the coiler 5. The stretcher-leveller zone 6 is formed by two successively arranged cylindrical stretcher-leveller work rolls 7 and a stretcher-leveller work roll of the second type 8. Cooling systems 9*a*, in the illustrated embodiment in the form of spray water nozzles, for influencing the strip temperature over the strip width or/and the thickness thereof are arranged between the work rolls 7 and 8 which are driven independently of each other. Another cooling system 9*b* is arranged closely in front of the coil. This cooling system 9*b* is schematically illustrated in FIG. 1 as a spray nozzle. Using this cooling system 9*b*, it is additionally possible to apply a gliding agent onto the strip in order to improve the gliding properties of the strip layers relative to each other during the cooling of the coil.

The strip material travels alternatingly over or under the stretcher-leveller work rolls 7, 8. The rolls are offset relative to each other in respect to the axis of rotation in such a way that the metal strip 1 is deflected at each of the stretcher-leveller work rolls. By interfering with the straight strip travel, existing stresses in the strip are influenced or new stresses are produced which have an advantageous effect on the flatness of the strip.

Figure 3:
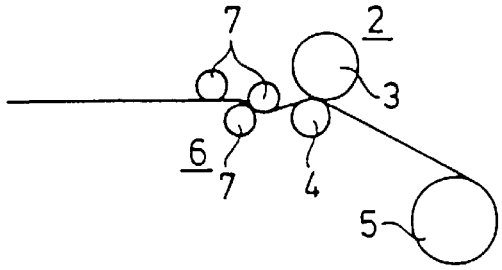
FIGS. 3 and 4 are schematic illustrations of embodiments of a stretcher-leveller zone formed by stretcher-leveller work rolls of the first type.
Figure 4:
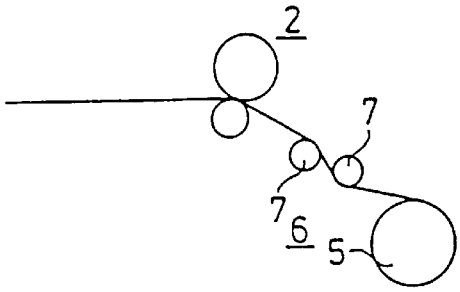

FIGS. 3 and 4 show embodiments of the stretcher-leveller zone 6 which is formed either by two or by three cylindrical stretcher-leveller work rolls 7. By means of the arrangement of the stretcher-leveller work rolls 7 following the driver 2, it is possible to eliminate unflatnesses produced in the pinch roll unit 2 prior to coiling the strip.

Figure 5:
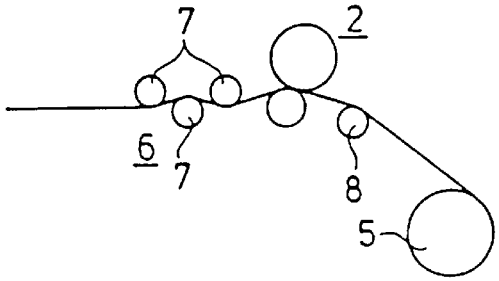
FIGS. 5 to 7 are schematic illustrations of embodiments of the stretcher-leveller zone formed by stretcher-leveller work rolls of the first and second type.

The embodiment of FIG. 5 corresponds of FIG. 3 except that an additional stretcher-leveller work roll of the second type 8 is arranged following the driver 2.

Figure 6:
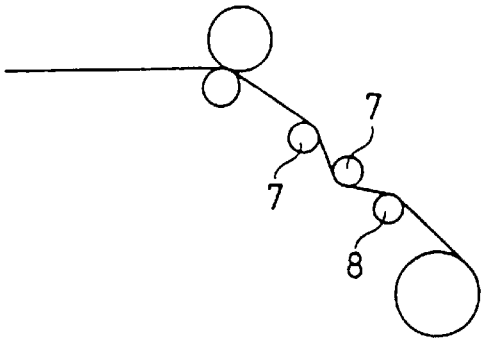

FIG. 6 shows the embodiment of the stretcher-leveller zone 6 of FIG. 4 except that, also in this case, a stretcher-leveller work roll of the second type 8 is provided as the last station of the metal strip before the coiling process.

Figure 7:
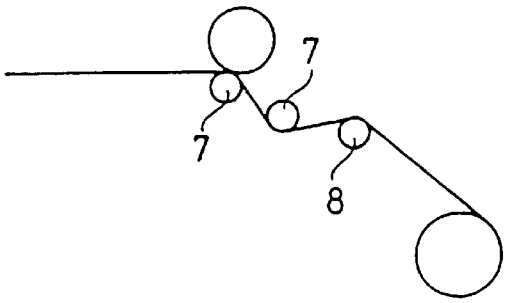

FIG. 7 shows a constellation of the rolls which is similar to that of FIG. 6. The difference is that the lower pinch roll 4 is utilized as the first stretcher roll.

Figure 8:
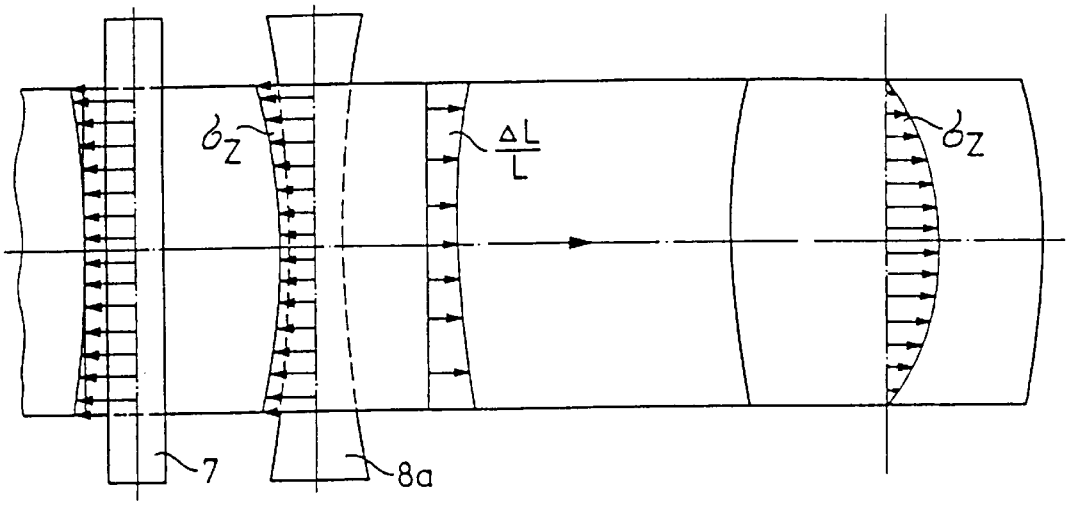
FIG. 8 is a diagrammatic illustration of the stress conditions in the metal strip when the roll of the second type has a negative crown.

FIG. 8 illustrates the stress conditions which exist when a stretcher-leveller work roll of the second type 8 with a negative crown is used. The above-described rolling conditions as well as high loads and wear of the rolls in the rolling plant produce unflatnesses in the metal strips and excessive stresses at the strip edges. In order to compensate the flatness changes from the hot state to the cold state, a stretcher-leveller work roll 8*a* with a negative crown is provided. This makes it possible to produce a length change at the strip edges and to produce in the strip treated in this manner a positive stress with a maximum in the middle and minimum stresses at the edges.

Figure 9:
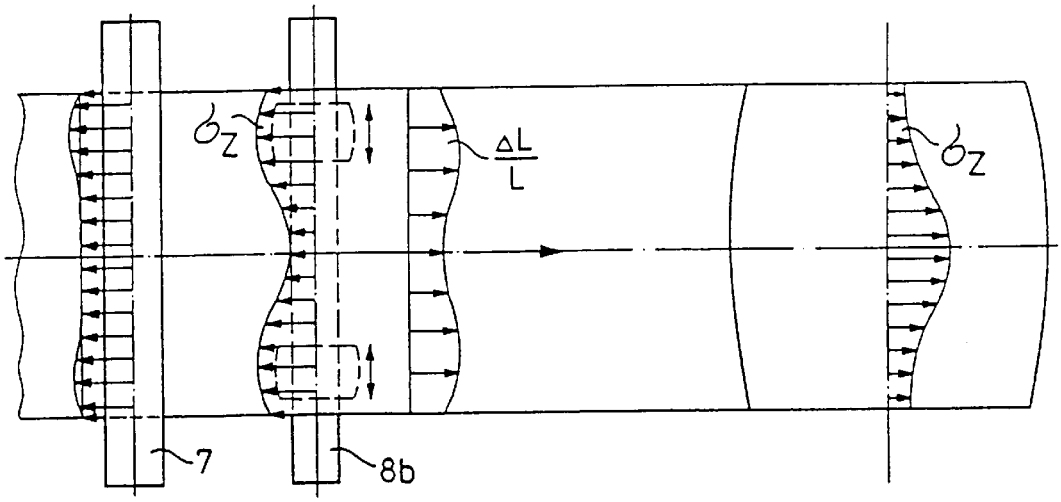
FIG. 9 is a diagrammatic illustration of the stress conditions in the metal strip when the roll of the second type is constructed of two parts.

When a stretcher-leveller work roll 8*b* composed of two parts is used, the stress distribution of the strip, diagrammatically shown in FIG. 9, can be influenced in dependence on its width, i.e., its flatness. As a result, a strip elongation of a higher degree, i.e., not parabolically, is achieved in order to advantageously influence the cold flatness.

Figure 10:
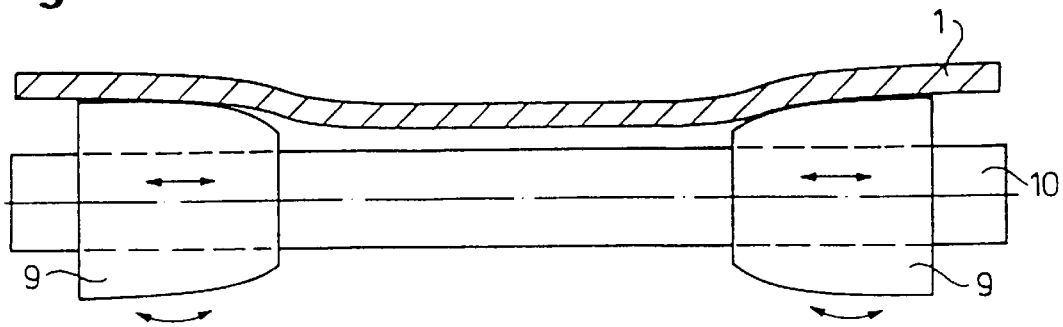
FIG. 10 is a sectional view of the roll of FIG. 9.

FIG. 10 is a schematic illustration of the roll 8*b* composed of two parts 9 in contact with the strip 1. The roll parts 9 are shiftable back and forth relative to each other. They are either mounted fixedly or so as to swing on a shaft 10.

In order to be able to better influence the properties of the stretcher-leveller work rolls it is proposed to provide the rolls with mechanical adjusting members. Possibilities in this connection are, for example, roll bending, an adjustable support roll or rolls or an inflatable roll. This makes it possible to variably influence the bending of the stretcher-leveller work rolls and, thus, the effect on the strip under load.

Figure 11:
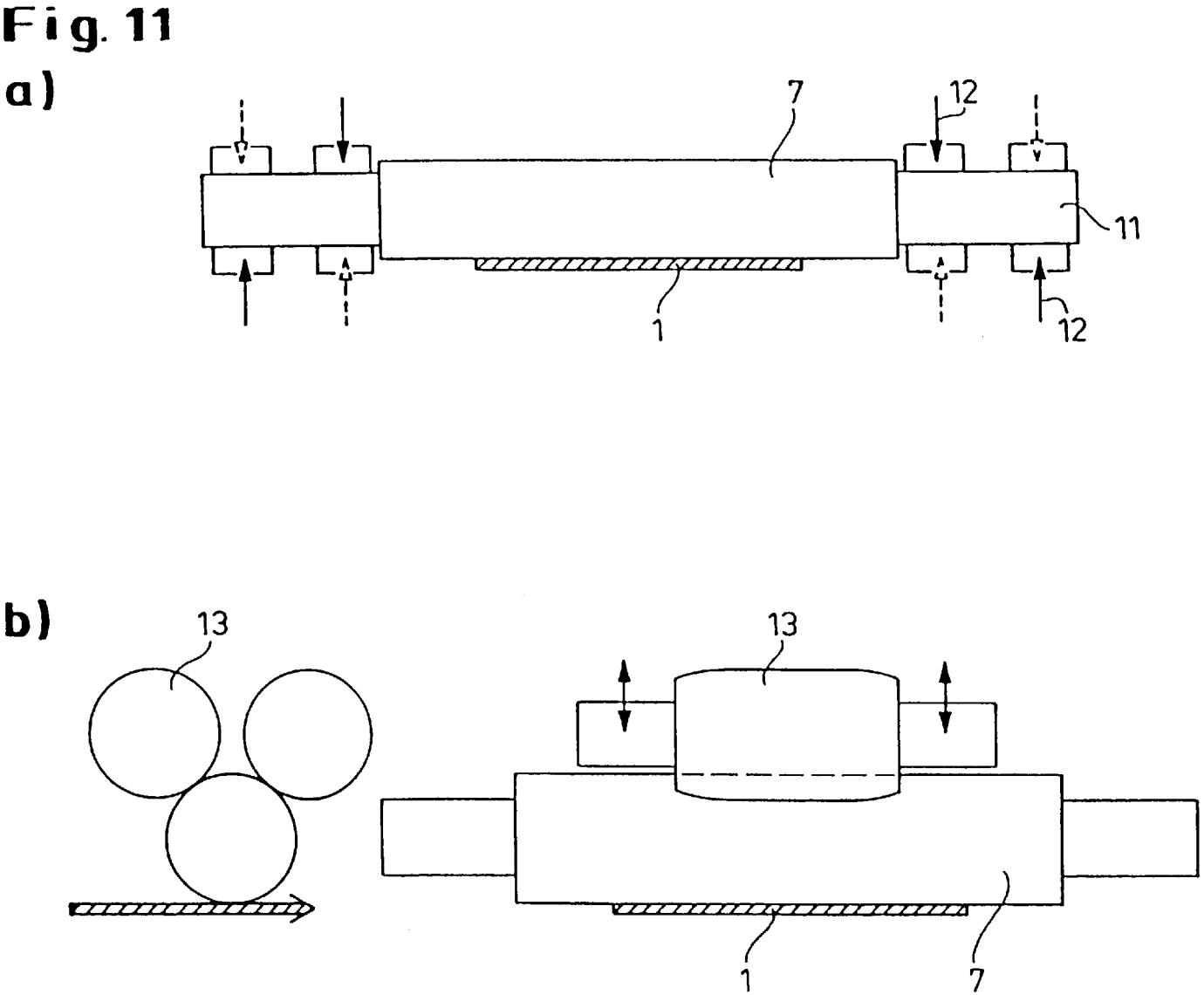
FIGS. 11*a, b* are schematic illustrations of mechanical adjusting members of the stretcher-leveller work roll.

FIG. 11*a* schematically shows the support of a stretcher-leveller work roll, wherein the bearing pins 11 are influenced by roll bending 12.

FIG. 11*b* illustrates the influence of one or two adjustable back-up rolls 13 and the arrangement thereof relative to the stretcher-leveller work rolls 7.

A plurality of influencing variables must be taken into consideration for the optimum adjustment of adjustment positions of the stretcher-leveller work rolls and the contact pressure as well as the adjustment of the mechanical adjustments for influencing the roll bending. The influencing variables are used as adjustment variables within control circuits.

Figure 12:
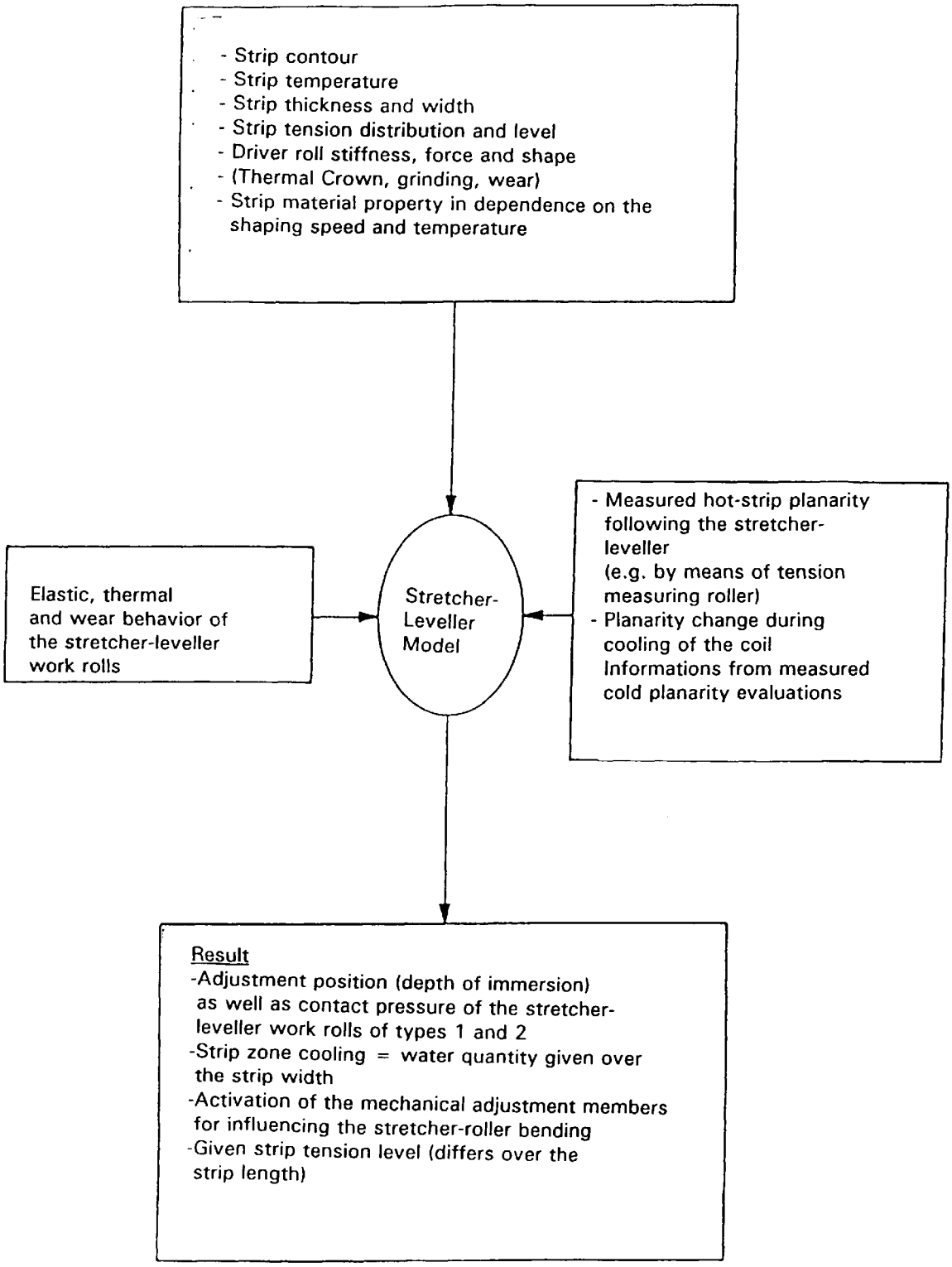
FIG. 12 is a diagram showing a stretcher-leveller model for the optimum adjustment of the stretcher-leveller work rolls.

FIG. 12 provides an overview of the influencing variables.

The influences are, on the one hand, the strip contour, the strip temperature distribution, the strip thickness and strip width, the strip tension distribution and the strip tension level, the pinch roll stiffness and the force and shape thereof (thermal crown, surface shape, wear) as well as the strip material properties in dependence of the deformation speed and temperature.

Added to this are the elastic behavior, the thermal behavior and the wear behavior of the stretcher-leveller work rolls. Additionally received by the stretcher-leveller model are data concerning the flatness change during cooling of the coil and informations obtained from measured cold flatness evaluations.

In the embodiment utilizing a tension measuring roller for measuring the flatness, the measured hot flatness following the stretcher-leveller zone also is included as an adjustment variable in the stretcher-leveller model.

After entering these parameters it is possible to determine and adjust an optimum adjusting position, i.e., depth of insertion, as well as an optimum contact pressure of the stretcher-leveller work rolls. In addition, it is possible to determine from this computation the quantity of cooling water over the strip width for strip zone cooling. In addition, an activation of the mechanical adjustment actuators for influencing bending of the stretcher rolls is possible.

Examples of the mechanical adjustment actuators are roll bending, adjustable back-up rolls or inflatable rolls. Also provided as an adjustment variable which can be influenced is the strip tension level which may be different over the strip length. It is provided in this connection that the adjustment actuators of the stretcher-leveller rolls and, thus, the tension level is adjustable so as to be different over the strip length. This means that different desired values are provided for the individual adjustment actuators.

The values which have been picked up can also be utilized as variables for regulating the cooling device arranged following the finishing train, so that, for example, the temperature distribution is made uniform over the strip width already by an adjusted cooling. Various cooling patterns are conceivable, for example, as disclosed in Patents DE 32 30 866 or EP 0 449 003 B1. To be taken into consideration is the fact that the strip cools more quickly at the edge than it does in the middle. Reduced cooling at the edges achieved, for example, by rendering the spray nozzles of a cooling beam inactive, compensates for these different temperatures over the strip width and produces a strip with a more uniform temperature distribution.

Figure 13A:
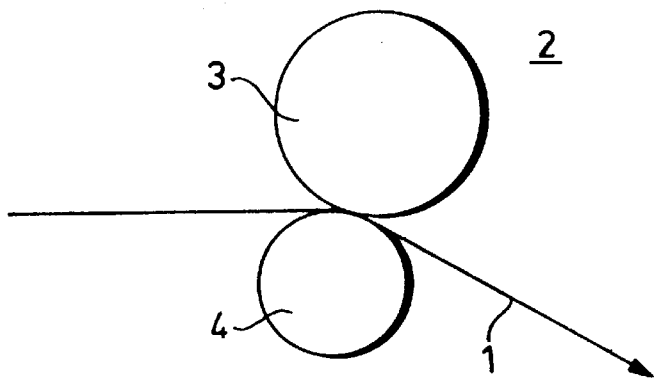
FIGS. 13*a*, 13*b* and 13*c* are schematic illustrations of the stretcher-leveller zone formed exclusively by the pinch rolls.
Figure 13B:
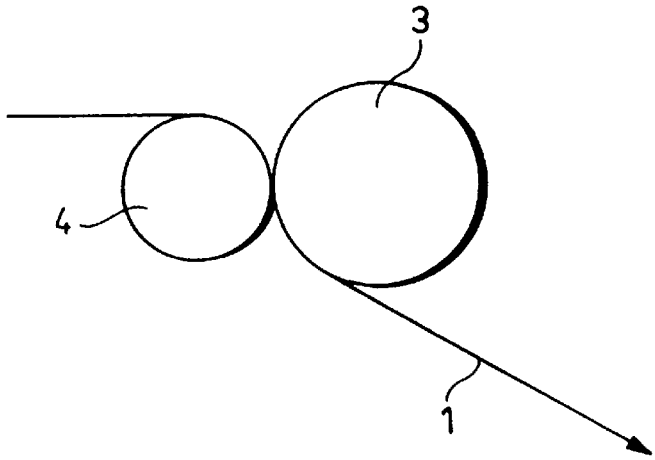
Figure 13C:
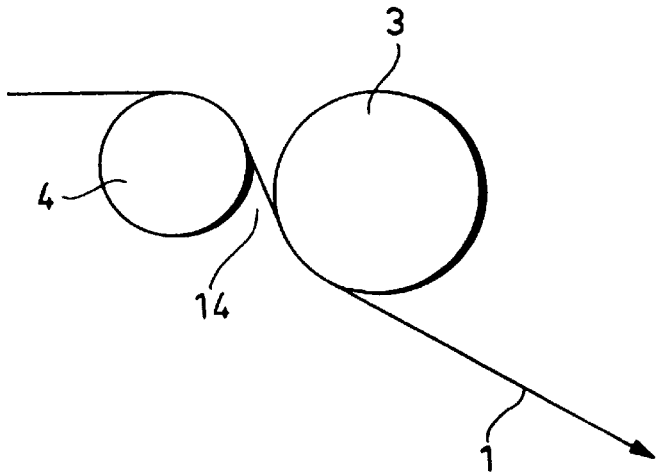

FIG. 13 shows another embodiment of an installation for carrying out the proposed method, wherein the stretcher-leveller zone is formed exclusively by the upper driver roll 3 and the lower pinch roll 4. After the coiler has grasped the strip beginning, as shown in FIG. 13*a*, the upper pinch roll 3 is swung downwardly and on the side of the lower pinch roll 4, as shown in FIGS. 13*b, c*. In this position, the pinch rolls 3, 4 operate as two stretcher-leveller work rolls. In this embodiment the stretcher-leveller zone is located following the original position of the pinch rolls. A gap 14 may optionally be adjusted between the lower pinch roll 4 and the upper pinch roll 3 when the pinch roll 3 is in the downwardly moved position, as shown in FIG. 13*c*.

Figure 14:
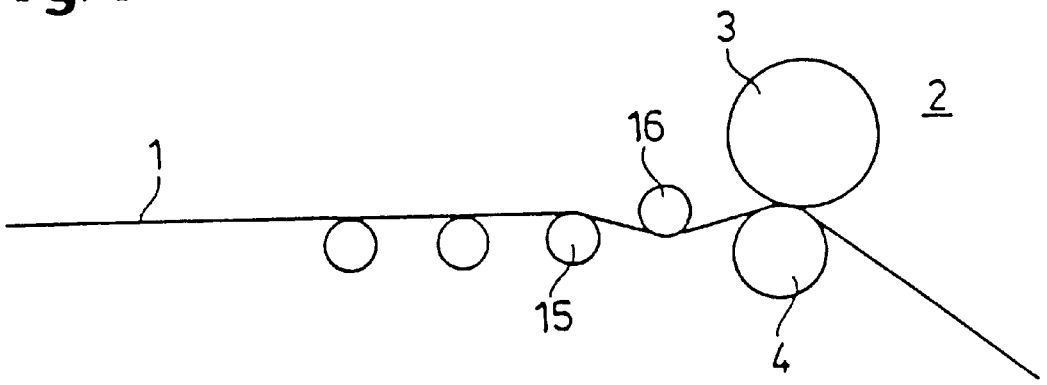
FIG. 14 is a schematic illustration of the stretcher-leveller zone formed by a roller table roller and a lower pinch roll.

Finally, in accordance with the embodiment of FIG. 14, the stretcher-leveller zone 6 is formed by a roll 15 of the roller table and by the lower pinch roll 4 of the pinch roll unit 2. For achieving a bending affect, the roll 16 is swung under the pass line.

Figure 15:
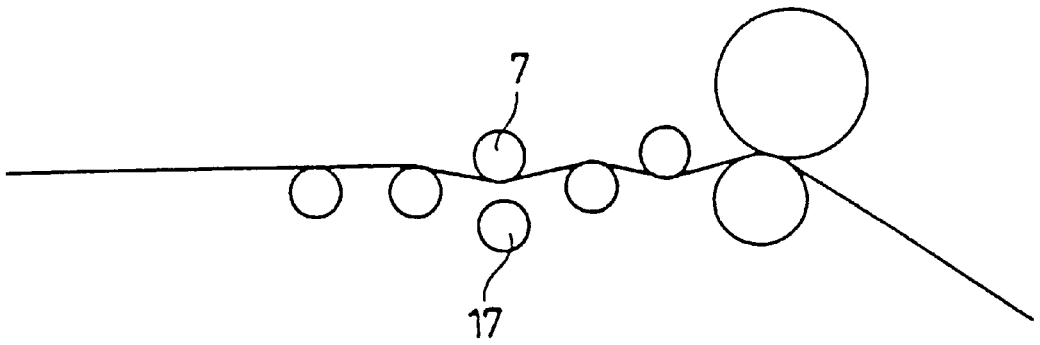
FIG. 15 is a schematic illustration of the arrangement of the stretcher-leveller rolls which are pressed against each other shortly before the strip end leaves the last roll stand.

FIG. 15 schematically shows an advantageous arrangement of the stretcher-leveller rolls shortly before the strip end leaves the finishing train. In this arrangement, the stretcher-leveller roll 7, for example, of the first type, is pressed against a roll 17 arranged therebelow in order to maintain the necessary backward tension. If no roll 17 is provided, a greater immersion depth or a greater bending dimension of the stretcher-leveller roll is selected in order to maintain the bending and stretching process when the strip end leaves the finishing train.

The method and the installation according to the present invention can be used generally in the manufacture of metal products. The invention is particularly intended for processing steels and aluminum.

While specific embodiments of the invention have been shown and described in detail to illustrate the inventive principles, it will be understood that the invention may be embodied otherwise without departing from such principles.

I claim:

1. A method of shaping metal strip in a hot strip rolling mill including a rolling train and a cooling line, a pinch roll unit composed of an upper pinch roll and a lower pinch roll and a coiling unit downstream of the rolling train, and a stretcher-leveller zone between an end of the cooling line and the coiling unit, the stretcher-leveller zone having at least two successively arranged stretcher-leveller work rolls, wherein the stretcher-leveller work rolls are arranged offset relative to each other, such that the metal strip is deflected at each stretcher-leveller work roll, the method comprising conducting the metal strip alternatingly over and under at least two successive stretcher-leveler work rolls which form the stretcher-leveller zone, further comprising controlling by means of a first controlled circuit an adjustment of the stretcher-leveller work rolls relative to each other and to the strip in dependence on at least one of strip properties and properties of the pinch rolls or the stretcher-leveller work rolls.

2. The method according to claim 1, comprising controlling by means of a second control circuit an adjustment of the cooling line in dependence on at least one of the strip properties and the properties of the pinch rolls or the stretcher-leveller work rolls.

3. The method according to claim 2, comprising controlling by means of a third control circuit mechanical adjustment actuators of the stretcher-leveller work rolls in dependence on the strip properties.

4. The method according to claim 3, comprising controlling by means of a fourth control circuit a strip tension level in dependence on at least one of the strip properties and the properties of the pinch rolls or the stretcher-leveller work rolls.

5. The method according to claim 4, comprising coupling at least two of the first control circuit, the second control circuit, the third control circuit and the fourth control circuit, wherein the control circuits use common desired values.

6. The method according to claim 4, wherein the strip properties are at least one of a strip contour, a strip temperature, a strip thickness, a strip width, a strip tension distribution and flatness properties of the strip after passing the stretcher-leveller zone.

7. The method according to claim 4, wherein the properties of the driver rolls or the stretcher-leveller work rolls are at least one of pinch roll stiffness, pinch roll force, pinch roll shape, and thermal behavior or wear behavior of the stretching-leveller work rolls.

8. An installation for shaping metal strip comprising a rolling train and a cooling line, a pinch roll unit composed of an upper pinch roll and a lower pinch roll and a coiling unit downstream of the rolling train, further comprising a stretcher-leveller zone between an end of the cooling line and the coiling unit, the stretcher-leveller zone comprising at least first and second successively arranged stretcher-leveller work rolls, wherein the stretcher-leveller work rolls are arranged offset relative to each other, such that the metal strip is deflected at each stretcher-leveller work roll, wherein the second stretcher-leveller work roll has one of a negative and a positive roll crown.

9. The installation according to claim 8, wherein the stretcher-leveller zone is comprised of two identical stretcher-leveller work rolls arranged at least one of in front of and following the pinch roll unit.

10. The installation according to claim 8, wherein the stretcher-leveller zone is comprised of two first stretcher-leveller work rolls in combination with another stretcher-leveller roller.

11. The installation according to claim 8, wherein the stretcher-leveller zone is comprised of two first stretcher-leveller work rolls in combination with an additional first stretcher-leveller work roll.

12. The installation according to claim 8, wherein the stretcher-leveller zone comprises cylindrical first stretcher-leveller work rolls.

13. The installation according to claim 8, wherein the second stretcher-leveller work roll comprises two separate stretcher roll bodies mounted so as to be displaceable relative to strip edges of the metal strip.

14. The installation according to claim 13, wherein the stretcher roll bodies are fixedly mounted.

15. The installation according to claim 13, wherein the stretcher roll bodies are mounted so as to be swingable on a shaft.

16. The installation according to claim 8, wherein the lower pinch roll is a first stretcher-leveller work roll.

17. The installation according to claim 8, comprising means for independently driving the stretcher-leveller work rolls.

18. The installation according to claim 8, further comprising a device for applying a gliding agent onto the strip.

19. An installation for shaping metal strip comprising a rolling train and a cooling line, a pinch roll unit composed of an upper pinch roll and a lower pinch roll and a coiling unit downstream of the rolling train, further comprising a stretcher-leveller zone between an end of the cooling line and the coiling unit, the stretcher-leveller zone comprising at least first and second successively arranged stretcher-leveller work rolls, wherein the stretcher-leveller work rolls are arranged offset relative to each other, such that the metal strip is deflected at each stretcher-leveller work roll, wherein the second stretcher-leveller work roll has one of a negative and a positive roll crown, wherein the stretcher-leveller work rolls have mechanical adjustment means selected from roll bending means, adjustable back-up rolls and inflatable rolls.

20. An installation for shaping metal strip comprising a rolling train and a cooling line, a pinch roll unit composed of an upper pinch roll and a lower pinch roll and a coiling unit downstream of the rolling train, further comprising a stretcher-leveller zone between an end of the cooling line and the coiling unit, the stretcher-leveller zone comprising at least first and second successively arranged stretcher-leveller work rolls, wherein the stretcher-leveller work rolls are arranged offset relative to each other, such that the metal strip is deflected at each stretcher-leveller work roll, wherein the second stretcher-leveller work roll has one of a negative and a positive roll crown, wherein the stretcher-leveller zone comprises a strip zone cooling unit.

21. The installation according to claim 20, wherein the strip zone cooling unit is a water cooling unit.

22. An installation for shaping metal strip comprising a rolling train and a cooling line, a pinch roll unit composed of an upper pinch roll and a lower pinch roll and a coiling unit downstream of the rolling train, further comprising a stretcher-leveller zone between an end of the cooling line and the coiling unit, the stretcher-leveller zone comprising at least first and second successively arranged stretcher-leveller work rolls, wherein the stretcher-leveller work rolls are arranged offset relative to each other, such that the metal strip is deflected at each stretcher-leveller work roll, wherein the second stretcher-leveller work roll has one of a negative and a positive roll crown, wherein the upper pinch roll is mounted so as to be pivotable laterally downwardly, and wherein the stretcher-leveller zone is comprised of the upper pinch roll and the lower pinch roll.

23. An installation for shaping metal strip comprising a rolling train and a cooling line, a pinch roll unit composed of an upper pinch roll and a lower pinch roll and a coiling unit downstream of the rolling train, further comprising a stretcher-leveller zone between an end of the cooling line and the coiling unit, the stretcher-leveller zone comprising at least first and second successively arranged stretcher-leveller work rolls, wherein the stretcher-leveller work rolls are arranged offset relative to each other, such that the metal strip is deflected at each stretcher-leveller work roll, wherein the second stretcher-leveller work roll has one of a negative and a positive roll crown, further comprising a flatness measuring roller arranged following the stretcher-leveller zone in a strip travel direction.

24. An installation for shaving metal strip comprising a rolling train and a cooling line, a pinch roll unit composed of an upper pinch roll and a lower pinch roll and a coiling unit downstream of the rolling train, further comprising a stretcher-leveller zone between an end of the cooling line and the coiling unit, the stretcher-leveller zone comprising at least first and second successively arranged stretcher-leveller work rolls, wherein the stretcher-leveller work rolls are arranged offset relative to each other, such that the metal strip is deflected at each stretcher-leveller work roll, wherein the second stretcher-leveller work roll has one of a negative and a positive roll crown, wherein one of the stretcher-leveller work rolls is a segmented tension measuring roll.

25. An installation for shaping metal strip comprising a rolling train and a cooling line, a pinch roll unit composed of an upper pinch roll and a lower pinch roll and a coiling unit downstream of the rolling train, further comprising a stretcher-leveller zone between an end of the cooling line and the coiling unit, the stretcher-leveller zone comprising at least first and second successively arranged stretcher-leveller work rolls, wherein the stretcher-leveller work rolls are arranged offset relative to each other, such that the metal strip is deflected at each stretcher-leveller work roll.

* * * * *